US005704414A

United States Patent [19]

Breviere

[11] Patent Number: 5,704,414

[45] Date of Patent: Jan. 6, 1998

[54] DEVICE FOR SUPPORTING A SIDE WALL OF AN INSTALLATION FOR THE TWIN-ROLL CONTINUOUS CASTING OF METAL STRIPS

[75] Inventor: Yann Breviere, Isbergues, France

[73] Assignees: Usinor Sacilor, Puteaux, France; Thyssen Stahl Aktiengesellschaft, Duisburg, Germany

[21] Appl. No.: 687,987

[22] Filed: Jul. 29, 1996

[30] Foreign Application Priority Data

Aug. 18, 1995 [FR] France ..... 95 09907

[51] Int. Cl.[6] ..... B22D 11/06

[52] U.S. Cl. ..... 164/428; 164/480

[58] Field of Search ..... 164/428, 480

[56] References Cited

U.S. PATENT DOCUMENTS 5,584,335 12/1996 Barbe et al. ..... 164/428

FOREIGN PATENT DOCUMENTS 0546206 6/1993 European Pat. Off. .
0698433 2/1996 European Pat. Off. .

*Primary Examiner*—Joseph J. Hail, III
*Assistant Examiner*—I.-H. Lin
*Attorney, Agent, or Firm*—Sixbey Friedman Leedom & Ferguson; Thomas W. Cole

[57] ABSTRACT

The invention relates to a device for supporting a side wall (2) of an installation for the twin-roll continuous casting of thin metal products of the type including two cooled rolls (1) with horizontal axes, two side walls (2) applied against the sides (3) of the rolls (1), said support device including a carriage (5) which can be displaced on command in a direction parallel to the axes of the rolls (1), a thrust device (6) carried by said carriage (5) and a panel (4), integral with the side wall (2), connected to said thrust device (6) by means of a thrust plate (8) and thrust members (9, 9', 9", 9'") bearing on said thrust plate (8) and said panel (4), wherein said panel (4) includes at least one tie (11, 11') passing through the thrust plate (8) and the free end of which is equipped with a stop (13, 13') which can be applied against the rear face (14) of said thrust plate (8).

8 Claims, 2 Drawing Sheets

DEVICE FOR SUPPORTING A SIDE WALL OF AN INSTALLATION FOR THE TWIN-ROLL CONTINUOUS CASTING OF METAL STRIPS

FIELD OF THE INVENTION

The invention relates to the continuous casting of metals. More specifically, it relates to devices for lateral confinement of the liquid metal in the ingot molds of machines for the continuous casting of thin strips, the casting space of which is limited by the lateral surfaces, which are brought together, of two rolls with horizontal axes, said rolls being cooled on the inside and rotated in opposite directions.

In this the of continuous-casting machine, known as "twin-roll casting", the industrial application of which to the casting of steel strips approximately 2 to 10 mm thick is currently being studied the lateral confinement of the liquid metal in the casting space defined by the rolls is provided by plates which are applied against the planar ends of the rolls, known as "sides", by a suitable device. These plates are usually denoted "side walls" or "side dams". Their central part which is to come into contact with the liquid metal is made from refractory material, as is, generally speaking, their periphery which is in frictional contact with the rolls and is progressively worn away. It is essential that they be in as leaktight contact as possible with the rolls because infiltrations of liquid metal into their contact zone would have disastrous effects on the quality of the edges of the cast strip. These would take on a serrated form and would be excessively brittle. They would then risk becoming detached from the rest of the strip and remaining bonded to the rolls. If such bonding were to persist for a complete revolution of the rolls and if the edge shreds were then to penetrate into the casting space, this would give rise to serious damage to the roll surfaces. At worst, these infiltrations of metal could reach the outside of the machine, which would require immediate interruption of casting.

Such sealing defects may have many causes, amongst which the following may be mentioned:

- deformations of the rolls and of the side walls caused by the mechanical and thermal stresses they experience, particularly at the very start of casting when they are placed under a thermal regime;
- the progressive wear of the side walls or of the rolls, which is not always uniform over the entire area of their contact zones;
- the instantaneous wear of the side walls caused by the passage of an infiltration of solidified metal.

PRIOR ART

It has already been proposed to solve these sealing problems by causing monitored wear of the side walls by means of their controlled frictional contact with the rolls. In this way, the contact surfaces of the side walls are permanently regenerated by being adapted as far as possible to any changes in the shape of those parts of the rolls on which they bear. In this connection, mention may be made of document EP-A-546206. This teaches firstly pressing the side walls vigorously against the rotating rolls before casting begins so as to make them match the precise initial configuration of the sides of the rolls. This pressure is then relaxed slightly and casting is started up, a high pressure being exerted again temporarily on the side walls so as deliberately to create wear which shapes the side walls to the sides of the rolls.

During casting, the side walls continue to be applied against the rolls, their wear being compensated for by displacement at a predetermined moderate speed. In this way, controlled wear is created, which permanently renews the contact surfaces between the side walls and the rolls.

French Patent Application FR9408319 improves this operating method and those deriving therefrom by providing means which make it possible slightly to deform the side walls by modulating the pressure applied to their different zones. In this way, account is taken of temporary or permanent inequalities in the stresses exerted on the various parts of the side walls by the rolls. Such inequalities may be produced, for example, in the event of spurious solidification of metal which has infiltrated between the side wall and a roll, or when the two sides of the rolls against which the side wall is applied are not perfectly coplanar and orthogonal to the axes of the rolls.

However, these operating methods have the drawback that they require each side wall to experience wear through frictional contact which can, admittedly, be measured by means of the speed of advance of the side wall, but which is not easily controlled. This may prove to be uselessly great if casting is uneventful.

SUMMARY OF THE INVENTION

The object of the invention is to provide the operator with the means for imposing monitored wear, on the sidewall, which would not be greater than what would be strictly necessary for satisfactory casting.

To this end, the subject of the invention is a device for supporting a side wall of an installation for the twin-roll continuous casting of thin metal products of the type including two cooled rolls with horizontal axes, two side walls applied against the sides of the rolls, said support device including a carriage which can be displaced on command in a direction parallel to the axes of the rolls, a thrust device carried by said carriage and a panel, integral with the side wall, connected to said thrust device by means of a thrust plate and thrust members bearing on said thrust plate and said panel, wherein said panel includes at least one tie passing through the thrust plate and the free end of which is equipped with a stop which can be applied against the rear face of said thrust plate.

As will have been understood, according to the invention, the panel supporting the side dam is equipped with one or more ties passing through the thrust plate and the free ends of which are able to abut against the rear face of the thrust plate. In this way, the thrust members, which normally tend to distance the panel from the thrust plate in order to apply the side wall against the rolls, causing wear thereof, have their action limited when this wear has become sufficiently pronounced for this abutment to be achieved. There is then only minimum frictional contact between the side wall and the rolls and wear of the side wall is virtually cancelled out.

DESCRIPTION OF THE DRAWINGS

The invention will be better understood on reading the following description which is given with reference to the following figures.

DESCRIPTION OF THE PREFERRED EMBODIMENTS

Figure 1:
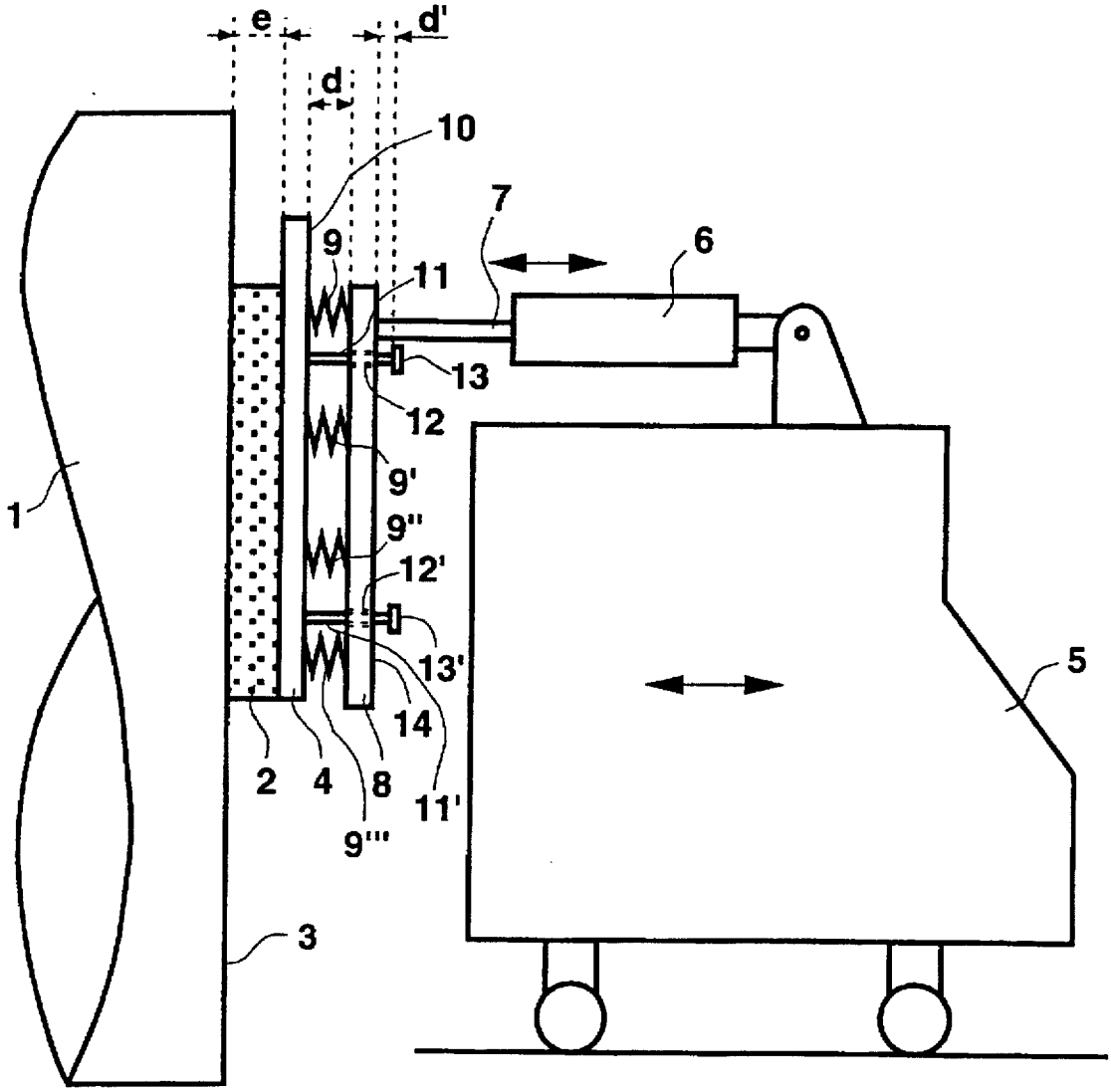
FIG. 1, which shows, diagrammatically, profile views of a device according to the invention and one of the casting rolls against which one of the side walls of the twin-roll casting machine is applied, the ties being in such a position that they permit progressive distancing of the panel from the thrust plate.

FIG. 1 shows a lateral part of a machine for casting between twin rolls, which are brought together and have horizontal axes, which are rotated and cooled on the inside, only one of the rolls 1 of which is visible. The other lateral part of the machine is similarly equipped. The casting space defined by the two rolls is closed off laterally by a side wall 2 made from refractory material, the front face of which is applied against the sides 3 of the rolls 1. The side wall 2 is fastened via its rear face to a panel 4 which is made from a material such as a metallic material. This panel 4 is preferably cooled in order to prevent it being affected by deformations of a purely thermal origin.

The displacements and the bearing force on the rolls 1 of the side wall 2 are controlled by a unit which acts on the panel 4 and which will be described in greater detail. In a known manner, it comprises a carriage 5 which is movable on command in a direction parallel to the axes of the rolls 1. This carriage 5 has mounted on it a thrust device 6, such as a ram (or a set of rams), slaved in terms of pressure or of position, including a rod 7 which can be displaced on command, still in the same direction parallel to the axes of the rolls 1. As in French Patent Application FR9408319 mentioned above, the rod 7 attacks a thrust plate 8 which itself carries a set of thrust members 9, 9', 9", 9'", such as springs or controlled rams, which exert their force on the rear face 10 of the panel 4. These members are distributed over a zone whose shape preferably corresponds to that of the side wall 2. Their usual function is to apply the side wall 2 vigorously against the sides of the rolls 1, by means of the panel 4. However, they permit a slight withdrawal of at least that portion of the side wall 2 which is located in their extension when a spurious solidification is interposed between it and one of the rolls 1, without the contact conditions between the remainder of the side wall 2 end the rolls 1 being greatly affected. Reference will be made to the text of the abovementioned French application for greater details.

Figure 2:
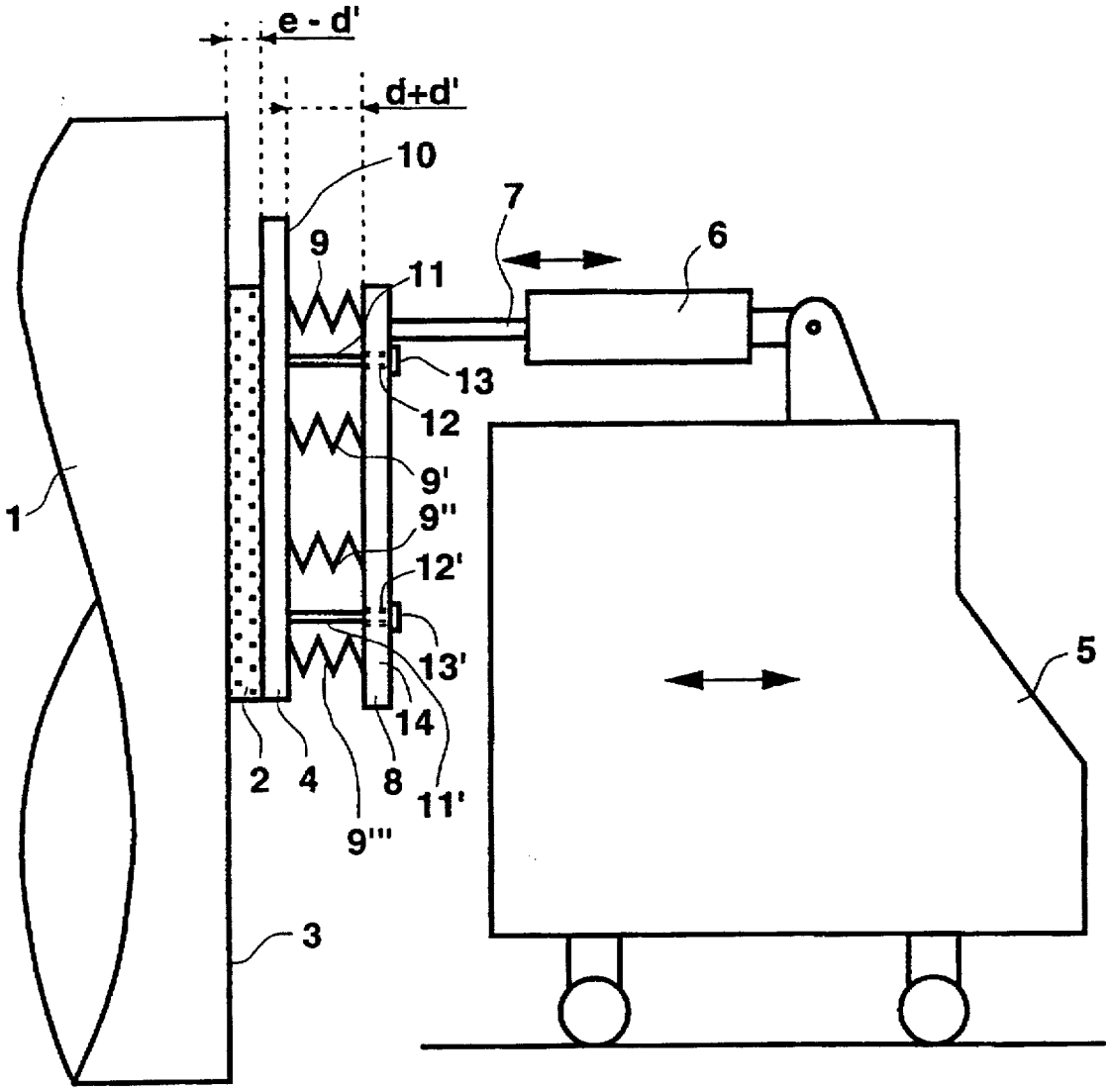
FIG. 2, which shows the same device but with the ties abutting against the rear face of the thrust plate.

According to the invention, in the example shown in FIGS. 1 and 2, a plurality of ties 11, 11' are fastened to the rear face of the panel 4 and oriented substantially perpendicularly to it. These ties 11, 11' pass through the thrust plate 8 via passages 12, 12' which are made therein for this purpose and their free end is equipped with a stop 13, 13' of dimensions greater than those of the passages 12, 12'. The lengths of the ties 11, 11' are chosen such that the stops 13, 13' are able to come to bear against the rear face 14 of the thrust plate 8 before the thrust members 9, 9', 9", 9'" have attained their maximum possible extension. The material of the ties must have good strength and dimensional stability properties at the temperatures encountered in this zone of the machine. It is recommended that use be made, for example, of a stainless steel with a low expansion coefficient.

FIG. 1 shows the installation in its initial state, at the start of casting, with a side wall 2 having a thickness (e). Given the initial position of the thrust device 6, the springs which, in the example shown, form the thrust members 9, 9', 9", 9'", are in a state of compression which corresponds to a distance (d) between the panel 4 and the thrust plate 8. Moreover, the stops 13, 13' of the ties 11, 11' are, in this initial state, at a distance (d') from the rear face 14 of the thrust plate 8.

FIG. 2 shows the same installation at a subsequent moment during casting. In the interval, the position of the thrust device 6 has not changed but the side wall 2 has experienced progressive wear owing to its frictional contact with the sides of the rolls 1. This wear has had the effect of gradually increasing the distance which separates the thrust plate 8 from the panel 4 through the action of the springs 9, 9', 9", 9'" and of the relaxation of their state of compression. This distance, or at least variations thereof, may be estimated, for example, with the aid of displacement sensors incorporated into the thrust members 9, 9', 9", 9'". When this wear has been such that the side wall has taken on a thickness equal to (e−d'), the distance between the thrust plate 8 and the panel 4 has taken on a value equal to (d+d') and the stops 13, 13' of the ties 11, 11' have come to bear against the rear face 14 of the thrust plate 8. This has had the effect of interrupting the advance of the panel 4 towards the rolls 1. At this moment, during normal run of the installation, the side wall 2 is applied against the sides of the rolls 1 with only a very weak force, guaranteeing minimum frictional contact between them, this being just sufficient to seal the casting space. This minimum frictional contact makes it possible to maintain very slight wear of the side wall 2 and thus to increase its service life.

Consequently, it is possible to propose the following casting procedure. Prior to casting, the installation is set up in the configuration described above and shown in FIG. 1. Casting is then started and, as a result of the progressive wear of the side wall 2, the end result is the configuration described above and shown in FIG. 2, in which the stops 13, 13' of the ties 11, 11' are in abutment against the rear face 14 of the thrust plate 8. The moment when this state is reached may be detected, for example, by displacement sensors incorporated in the thrust members 9, 9', 9", 9'". If solidified metal becomes inserted between the side wall 2 and one of the rolls 1, the side wall 2/panel 4 assembly can withdraw at least locally, this withdrawal being all the more localized if this assembly has a degree of flexibility and if there is a larger number of thrust members 9, 9', 9", 9'". At this moment, the stop 13, 13' of one or more ties 11, 11' is no longer in contact with the thrust plate 8 and the thrust member or members 9, 9', 9", 9'" which are closest to the zone where the infiltration has occurred resume their function of vigorously applying the side wall 2 against the rolls 1. This lasts until the infiltration has disappeared, if its presence is only temporary, or, if the infiltration persists for some time, until the local wear of the side wall 2 gives rise to renewed contact between the stop or stops 13, 13' and the thrust plate 8.

In order periodically to regenerate the surface of the side wall 2 which is in contact with the rolls 1 and thus to prevent too pronounced local wear compromising the sealing conditions at its level, provision is made for the rod 7 of the thrust device 6 to be moved periodically in the direction of the rolls 1. The thrust plate 8 is thus brought closer to the rolls 1, which results in a distancing of the stops 13, 13' of all the ties 11, 11' from the thrust plate 8 and the resumption of vigorous application of the side wall 2 against the rolls 1 by the thrust members 9, 9', 9", 9'". This vigorous application lasts as long as the wear of the side wall 2 is sufficiently pronounced for the contact between the stops 13, 13' and the thrust plate 8 to be produced again and for the desired minimum frictional-contact contact conditions to thus be recreated. The choice may be to carry out this operation on a regular basis by imposing an average displacement speed of the order of 1 to 10 mm/h on the thrust plate 8. This displacement speed corresponds to the speed of wear which it is desired to impose on the side wall 2 in the absence of infiltrations of solidified metal. This speed is markedly slower than those which are usually imposed by conventional devices for applying the side walls against the rolls and which are measured in some tens of mm/h. The choice may also be to superimpose greater episodic displacements on this periodic systematic displacement of the rod 7 at times determined by the operator or the robot managing the functioning of the installation. This may be the case when, for example, withdrawals of relatively large size have been observed over part or all of the side wall 2, which would indicate the presence of infiltrations of solidified metal between the side wall 2 and the rolls 1 capable of giving rise to exceptional wear of the side wall 2. In this case, it is desirable to obtain rapid regeneration of the side wall 2/rolls 1 contact surface, permitting a displacement of the rod 7 which is carried out with this precise intention.

In principle, the presence of a single tie placed, for example, in the central region of the panel 4 supporting the side wall is sufficient to obtain the desired effect. However, it is preferable to provide a plurality of ties 11, 11' (for example, three) distributed on the panel 4 over a zone with a shape corresponding to that of the side wall 2. In this way, particularly when the side wall 2/panel 4 assembly has a degree of flexibility or movement possibilities in the three dimensions, it is possible to take better account of the localized withdrawals of the side wall 2 and of the alignment defects of the sides of the rolls 1 with respect to one another. For displacements of the ties 11, 11' not to be hampered during movements of the panel 4 which might not be strictly parallel to the axis of the rolls 1, it is necessary to provide sufficient play between the ties and the walls of the passages 12, 12' made for them in the thrust plate 8.

The invention is, moreover, perfectly compatible with the use of side walls 2 which, as is known, would be given an oscillating movement in the plane of the planar faces of the rolls 1, 1'.

The device according to the invention may be supplemented by one or more position sensors supplying a representative value, at least at a given instant, of the distance between the side wall 2 and the rolls 1. They make it possible to ensure that, during those phases when wear of the side wall 2 is sought, there is indeed contact between the side wall and the rolls 1. Moreover, when the installation is operating normally, it may be desired that this contact should not quite occur and that efforts be made to maintain permanently a clearance of 0.1 to 0.2 mm, which is sufficiently small to prevent leaks of liquid metal but makes it possible to eliminate wear of the side wall 2 by frictional contact. Only corrosion by the liquid metal would then remain as a cause of wear. It is advantageous to incorporate these sensors (for example of the capacitive type) into the stops 13, 13' of the ties 11, 11' in order to measure their distance to the thrust plate 8. Thus, when the extension of the thrust members 9, 9', 9", 9'" can be adjusted on command (if, for example, these are controlled rams), it is possible, after the stops 13, 13' have come into contact with the thrust plate 8, to cause the side wall 2 to withdraw by reducing the extension of the thrust members 9, 9', 9", 9'" by a distance corresponding to this play.

I claim:

1. A device for supporting a side wall of an installation for the twin-roll continuous casting of thin metal products including two cooled rolls with horizontal axes, two side walls applied against the sides of the rolls, said support device including a carriage which can be displaced on command in a direction parallel to the axes of the rolls, a thrust device carried by said carriage and a panel, integral with the side wall, connected to said thrust device by means by a thrust plate and thrust members bearing on said thrust plate and said panel, the amount of thrust force that said thrust members apply to said panel diminishing with a length of extension of said thrust members, wherein said panel includes at least one elongated tie having a length passing through the thrust plate parallel to a direction of extension of said thrust members and having a free end of which is equipped with a stop which can be applied against the rear face of said thrust plate, the length of said tie being chosen so that the thrust members have extended to a length associated with a thrust force that results a sealing force with minimum frictional contact between said side wall and rolls when said tie stop is applied against said face of said thrust plate.

2. The device as claimed in claim 1, wherein said panel includes three ties.

3. The device as claimed in claim 1, wherein said ties are distributed over a zone with a shape corresponding to that of the side wall.

4. The device as claimed in claim 1, wherein said thrust members are springs.

5. The device as claimed in claim 1, wherein said thrust members are controlled rams.

6. The device as claimed in claim 1, including at least one sensor supplying a representative value, at least at a given instant, of the distance between the side wall and the rolls.

7. The device as claimed in claim 6, wherein said position sensor is adapted for measuring of the distances between the stops of the ties and the thrust plate.

8. The device as claimed in claim 6, wherein said position sensor is a capacitive sensor.

* * * * *